US006394231B1

(12) United States Patent
Schuster et al.

(10) Patent No.: US 6,394,231 B1
(45) Date of Patent: May 28, 2002

(54) METHOD OF COMMUNICATION OF TRAVEL DESTINATION INFORMATION BETWEEN USER AND A PLURAL VEHICLE TRANSPORT SYSTEM

(75) Inventors: Kilian Schuster, Ballwil; Paul Friedli, Remetschwil, both of (CH)

(73) Assignee: Inventio AG, Hergiswil (CH)

( * ) Notice: Subject to any disclaimer, the term of this patent is extended or adjusted under 35 U.S.C. 154(b) by 0 days.

(21) Appl. No.: 09/553,263

(22) Filed: Apr. 20, 2000

(30) Foreign Application Priority Data

Apr. 22, 1999 (EP) ..... 99810337

(51) Int. Cl.[7] ..... B66B 1/18
(52) U.S. Cl. ..... 187/382; 187/388; 187/247
(58) Field of Search ..... 187/391, 393, 187/247, 395, 396, 397–399

(56) References Cited

U.S. PATENT DOCUMENTS

| | | | | | |
|---|---|---|---|---|---|
| 3,658,155 | A | | 4/1972 | Salter | |
| 4,852,696 | A | * | 8/1989 | Fukuda et al. | 187/139 |
| 4,989,694 | A | * | 2/1991 | Ueshima et al. | 187/121 |
| 5,300,738 | A | | 4/1994 | Kostka et al. | |
| 5,382,761 | A | * | 1/1995 | Amano | 187/383 |
| 5,689,094 | A | * | 11/1997 | Friedli et al. | 187/384 |
| 5,831,226 | A | * | 11/1998 | Hattori et al. | 187/382 |
| 5,886,696 | A | * | 3/1999 | Kakko et al. | 187/399 |
| 6,011,839 | A | * | 1/2000 | Friedli et al. | 187/388 |
| 6,065,570 | A | * | 5/2000 | Friedli et al. | 187/387 |

FOREIGN PATENT DOCUMENTS

| | | | | |
|---|---|---|---|---|
| EP | 0 534 123 | | 3/1993 | |
| JP | 2106578 | A * | 4/1990 | 187/391 |
| JP | 3293275 | A * | 12/1991 | 187/390 |
| JP | 6321445 | A * | 11/1994 | 187/391 |

* cited by examiner

*Primary Examiner*—Jonathan Salata
(74) *Attorney, Agent, or Firm*—MacMillan, Sobanski & Todd, LLC

(57) ABSTRACT

A transport system with several autonomous vehicles includes a terminal for a user to input his travel destination. The boarding location and the allocated vehicle are selected for serving the travel request and this information is communicated to the user as an allocated symbol on a display of the terminal. The user can then go to the indicated boarding location. As vehicles arrive at the boarding location, each is indicated on another display by a flashing symbol associated with that vehicle. Thus, the user knows to board only when the flashing symbol corresponds to his allocated symbol.

11 Claims, 2 Drawing Sheets

METHOD OF COMMUNICATION OF TRAVEL DESTINATION INFORMATION BETWEEN USER AND A PLURAL VEHICLE TRANSPORT SYSTEM

BACKGROUND OF THE INVENTION

The present invention relates to a method for communication with a transport system that comprises vehicles of high autonomy and in which at least one man/machine interface is provided for the input of travel destinations and for information of the user.

A transport system in which several elevator cars run autonomously in an elevator shaft is shown in the U.S. Pat. No. 3,658,155. Each elevator car has an own drive and can move horizontally as well as vertically. On one side of the elevator shaft the elevator cars, guided by rails, travel up and on the other side of the elevator shaft the elevator cars travel back to the starting point. For serving the floors, the elevator cars branch from the vertical main direction into a horizontal blind alley. The branches are controlled by points. Due to the lack of details about the communication of the passengers with the transport system, the assumption is that the autonomous elevator cars work in taxi operation. If a floor call is present, an elevator car travels to the floor calling and thereafter carries out the transport request of the user.

A disadvantage of the known equipment is that the transport capacity of the transport system cannot be fully utilized. Moreover, a dividing up of the flow of people is not possible.

SUMMARY OF THE INVENTION

The present invention concerns a method for communication with a transport system having vehicles of high autonomy relative to serving users and in which at least one man/machine interface is provided for input by a user of travel destinations and information of the user. The method comprises the steps of: a. providing a terminal at a boarding floor for inputting a travel destination transport request of a user, the transport request including information related to a starting position and a destination position; b. sending the transport request from the terminal to each of a plurality of vehicles that can serve the travel request; c. examining for each of the vehicles a feasibility of serving the transport request; d. sending from the vehicles to the terminal at least one offer to serve the travel request; e. when at least two offers are received by the terminal, selecting a boarding location and a vehicle for serving the transport request; and communicating an identification of the selected boarding location and the selected vehicle to the user in symbol form.

Here, the present invention creates a remedy. The present invention meets the object of avoiding the disadvantages of the known equipment and of proposing a method that improves the communication of the user with a transport system with autonomous vehicles and improves the vehicle utilization.

The advantage achieved by the present invention is that a dividing up of the flow of people amongst the autonomous vehicles can take place unhindered. The time for boarding the appropriate vehicle can be minimized, which in turn facilitates route planning and improves the transport performance of the entire transport system. Moreover, it is ensured that the user actually uses the vehicle provided for him even when the boarding location is not only associated with the provided vehicle.

DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
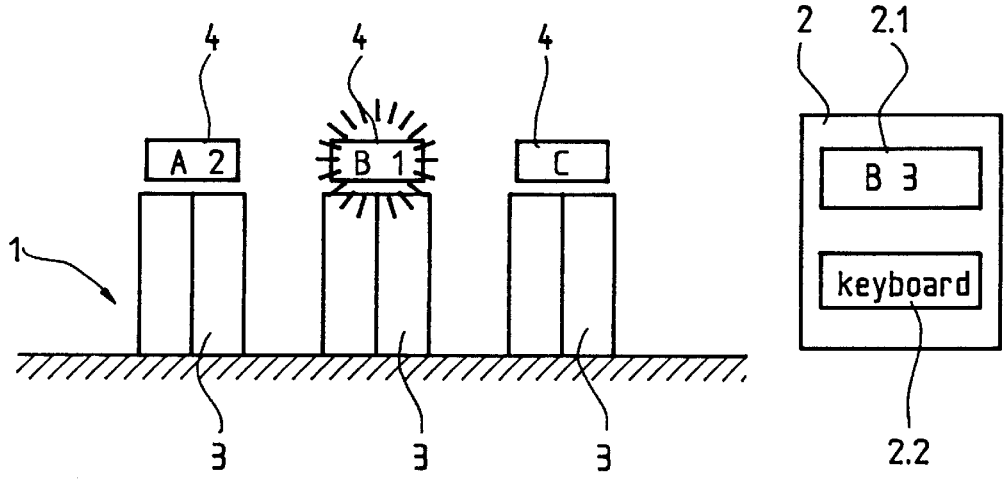
FIG. 1 is a schematic view of a man/machine interface at a stopping point of a transport system with boarding locations in accordance with the present invention.

As shown in the FIG. 1, the hardware of a man/machine interface of a stopping point 1 of a transport system consists of at least one terminal 2, of a plurality of displays 4 each associated with one of a plurality of boarding locations 3 and optionally of at least one audio unit (not shown). The terminal 2 includes a keyboard 2.1, for example a decade keyboard, and a display 2.2. The terminal 2 can also be a touch screen in which the form of keyboard is controllable and in which the keyboard and the display can be represented on a screen. The stopping point 1 is shown with, for example, three boarding locations 3 formed as shaft doors. The transport system 1 can be, for example, an elevator system with at least one elevator shaft in which at least one vehicle or at least one elevator car runs with, in the matters of control and drive, high autonomy, wherein the direction of movement can be vertical and/or horizontal.

FIG. 1 shows an example of a destination call input of a user and the display of the allocation of the corresponding vehicle, wherein alphanumeric symbols are used. The user inputs his travel destination at the terminal 2. Subsequently, the vehicle and the boarding location, for example the symbols "B" and "3", are communicated on the terminal display 2.1 to the user. The symbol "B" designates the boarding location and the symbol "3" designates the allocated vehicle, which is provided for the realization of the travel request and which carries out the travel request. The user now goes to the boarding location "B" which is the middle one of the three locations 3. In the interim, the vehicle "1" arrives at the boarding location "B", which is displayed on the associated display 4 by flashing with the symbols "B" and "1". The user knows that the vehicle "1" is not his allocated vehicle from the display 2.2. He boards only when the symbols "B" and "3" are displayed flashing on the associated display 4 above the middle location 3.

Other easily remembered symbols can be used for the travel destination, such as for example names, telephone numbers, pet names for kindergartens, acoustic signals, pictures, signs, colors, etc. Symbols can also be used which permit a subordination of further symbols, for example "animals" for the boarding location and, for example "hare" for vehicle "1", "horse" for vehicle "2", "bird" for vehicle "3", etc. In cases in which the vehicle symbol used is a subordination of the boarding location symbol, the communication of the boarding location can be dispensed with. It is sufficient, for example, to display "horse" because the user can, if the ordering is clear, remember the superordination of the boarding location symbol and present himself at the stopping point of the "animals".

Different symbols for each vehicle are also possible insofar as the symbol concerned has not already been used for an allocation in the process of being carried out. Also, several symbols can be allocated for different users for a vehicle at the same stopping point.

Figure 2:
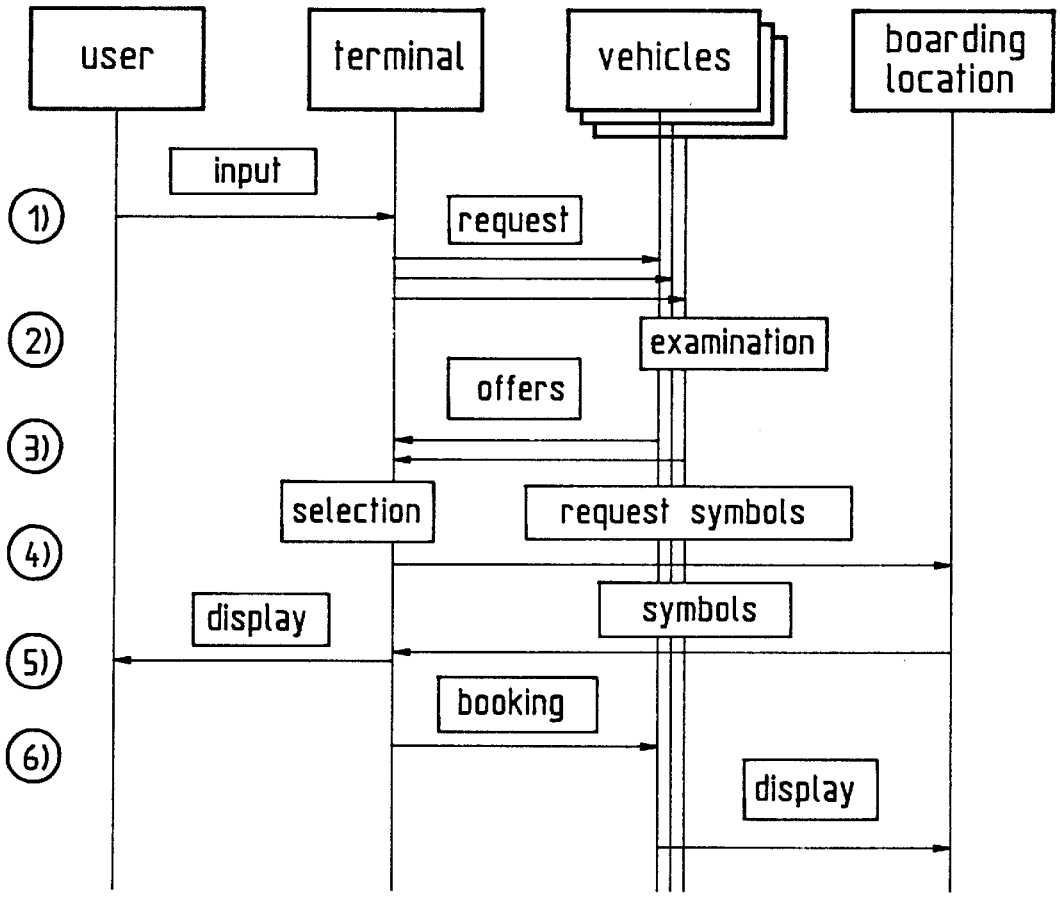
FIG. 2 is flow diagram showing a communication sequence of the man/machine interface and of the transport system shown in the FIG. 1.

The FIG. 2 shows a flow diagram of the individual communication steps of the destination call input up to completion of the transport request at a stopping point. Extending down the left side of the FIG. 2 are the communication steps "1)" through "6)". Extending across the top of the FIG. 2 are the points among which communication flows: the "user"; the "terminal"; the "vehicles"; and the "boarding location". In the first step "1)", the user inputs his desired travel destination (input) at the terminal 2. Altogether, an information packet is generated which comprises the starting position, the destination position of the user and, if need be, also data of the user. In the second step "2)", the terminal 2 triggers by the information packet a query (request) to the vehicles, which examine (examination) the feasibility of assignment of the request on the basis of an individual travel costs computation. The vehicles communicate the examination result together with the remaining starting positions/destination positions in the form of an offer (offers) to the terminal 2. In the case of several feasible variants, the optimum route is determined and a schedule is drawn up in accordance with which the users are served. In the third step "3)" the terminal 2 selects the most favorable travel variant for the users (selection) and obtains an unambiguous symbol from a symbol manager of the corresponding boarding location (request symbols).

In the fourth step "4)" the symbol is made available by the manager (symbols), which has a list of the symbols which are allocated. New symbols may not be entered in the list which are the same as already allocated symbols. In the fifth step "5)", the allocated symbol is communicated by means of the terminal display 2.1 to the user (display) and to the vehicle selected for the transport together with the booking booking). In the sixth step "6)", the allocated symbol is, on arrival of the vehicle at the boarding location, displayed on the display 4 (display) and removed from the list of allocated symbols. The user then boards the vehicle and is transported to his destination. Several boarding locations can also be associated with one of the terminals 2. The management then takes place through a common authority. It is then incumbent on the respective user to locate the allocated symbol. The steps "1)" to "6)" apply even when the transport system consists of only one vehicle, which simulates, in sequential succession, several vehicles. As a variant, the boarding location can be established and allocated to the terminal 2. Moreover, a portable terminal, for example in the form of a wristwatch, which communicates with the stationary terminal 2, can be provided for the user.

Figure 3:
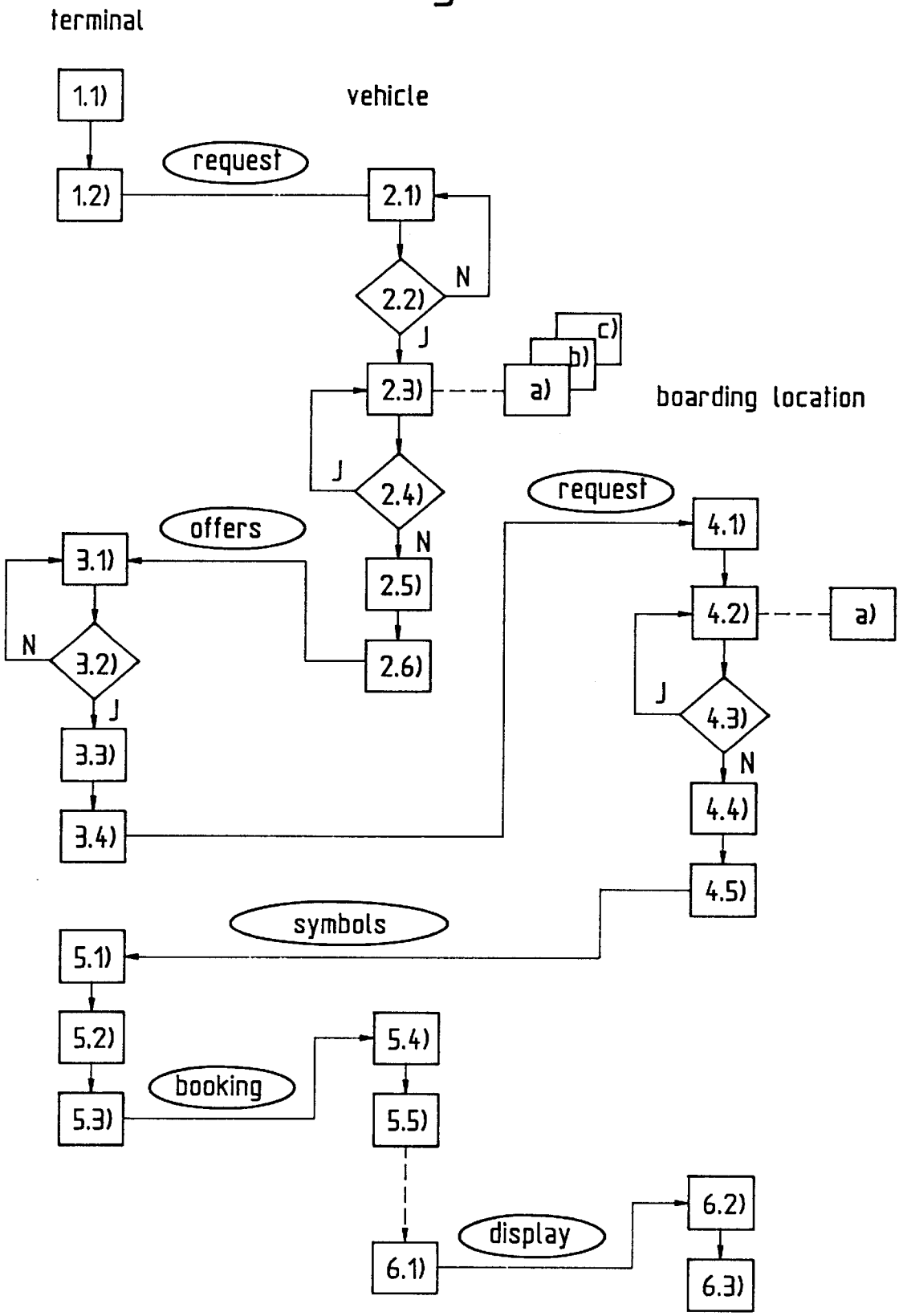
FIG. 3 is a more detailed flow diagram of the communication sequence shown in the FIG. 2.

The FIG. 3 shows details of the communication steps "1)" to "6)" in the form of a flow chart, wherein steps concerning the terminal, the vehicle and the boarding location and the linkings thereof are illustrated.

In a step "1.1)" concerning the terminal, the destination position is read in from the keyboard. Subsequently, in a step "1.2)", the starting position, destination position and if need be further information concerning the user or the transport, such as for example the departure time of the vehicle, is passed on as a query (request) for the setting of an offer.

In a step "2.1)" concerning the vehicle, the query of the step "1.2)" is received and it is examined in an iteration step "2.2)" to determine whether the request is feasible for the vehicle. The examination takes place on the basis of attainable stopping points, the instantaneous operational state and, if need be, further parameters such as maximum load, door width, etc. In a step "2.3)", the scheduling of the requested journey takes place based on: "a)" the requests already booked; "b)" the route particulars; and "c)" the traffic situation on the routes. Subsequently, the schedule is stored. In an iteration step "2.4)" it is investigated whether the parameters are variable.

If specific parameters are not clearly established, further schedules can be drawn up by variation of the still free parameters. In a step "2.5)" the best schedule is selected on the basis of specific criteria and stored together with the request and the relevant details for the scheduled transport, such as for example boarding location and disembarking location, as offers. In a step "2.6)" the issue of the precise boarding location, the disembarking location as well as further details relative to the transport takes place in response to the requesting point of the step "1.2)".

In a step "3.1)" concerning the terminal, the offers of the step "2.6)" are received and stored. It is checked in an iteration step "3.2)" whether the waiting time has elapsed or whether sufficient offers are put in. The selection of the best offer and the storage of the relevant data takes place in a step "3.3)" according to specific criteria. With a step "3.4)", a request concerning a symbol comprising boarding location and selected vehicle is triggered.

In a step "4.1)" concerning the boarding location, the request of the step 3.4) is received. In the step 4.2) a vehicle symbol is selected from the list a) of available symbols and in the subsequent iteration step 4.3) it is checked whether the selected symbol is already allocated. In the step 4.4) the selected, free symbol is marked as allocated. In the following step 4.5) the vehicle symbol and the boarding location symbol are issued in response to the requesting point of the step 3.4).

In the step 5.1) concerning the terminal, the symbol describing boarding location and vehicle is received and displayed for the user in a step "5.2)". In a step "5.3)" the reservation of the vehicle takes place by booking the offer at the selected vehicle of the step "3.3)" together with the symbol that has been allocated.

In a step "5.4)" concerning the vehicle, the booking of the step "5.3)" is received. In a step "5.5)", the request, which is marked as offered, of the step "2.5)" is entered as booked, complemented by the vehicle symbol. In a step "6.1)" all vehicle symbols of the boarding users, stored from the step "5.5)", are then issued to the next stopping point called at.

The vehicle symbols of the step "6.1)" are displayed in a step "6.2)" concerning the boarding location. Finally, the symbol is marked as free in the list of available symbols in a step "6.3)".

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A method for communication with a transport system having vehicles of high autonomy relative to serving users and in which at least one man/machine interface is provided for input by a user of travel destinations and information of the user, comprising the steps of:

a. providing a terminal at a boarding floor and inputting to the terminal at least a desired travel destination of a user;

b. generating from the terminal a request representing the desired travel destination and the boarding floor, and receiving the request by at least two high autonomy vehicles serving the boarding floor and the travel destination;

c. causing each of the vehicles receiving the request to examine the request for feasibility of service on the basis of an individual travel costs comparison;

d. generating from each of the vehicles to the terminal an offer to serve the request from a predetemined boarding location at the boarding floor; each of the offers also including results of the examination and remaining starting positions/destination positions to be served associated with the corresponding vehicle;

e. causing the terminal to select one of the offers; and f. communicating to the user at the terminal an identification of the predetermined boarding location and the selected vehicle associated with the selected offer.

2. The method according to claim 1 wherein the request includes data related to the user.

3. The method according to claim 1 wherein said step e, is performed by selecting a one of the offers most favorable for the user.

4. The method according to claim 1 wherein said step f, is performed by displaying at least one symbol to the user.

5. The method according to claim 4 including a step of storing a list of symbols currently allocated to pending user requests, entering newly allocated symbols to the list and erasing corresponding allocated symbols from the list on arrival of an associated selected vehicle at an associated boarding location.

6. The method according to claim 5 wherein the symbols each represent at least one of the associated boarding location and the associated vehicle in an easily remembered form.

7. A method for communication with a transport system having vehicles of high autonomy relative to serving users and in which at least one man/machine interface is provided for input by a user of desired travel destinations and information of the user, comprising the steps of:

a. providing a terminal at a boarding floor and inputting to the terminal a desired travel destination of a user;

b. generating from the terminal a request representing the desired travel destination and the boarding floor, and receiving the request at a plurality of high autonomy vehicles each serving the boarding floor and the desired travel destination;

c. causing each of the vehicles to examine the request for feasibility of service;

d. for each of the vehicles for which service of the request is feasible, Generating an offer to serve the request from a predetermined boarding location at the boarding floor;

e. causing the terminal to select a one of the offers most favorable to the user; and f. communicating to the user at the terminal an identification of the predetermined boarding location and the selected vehicle associated with the selected offer.

8. The method according to claim 7 wherein said step f, is performed by displaying at least one symbol to the user.

9. The method according to claim 7 including a step of storing a list of symbols currently allocated to pending user requests, entering newly allocated symbols to the list and erasing corresponding allocated symbols from the list on arrival of an associated selected vehicle at an associated boarding location.

10. The method according to claim 9 wherein the symbols each represent at least one of the associated boarding location and the associated vehicle in an easily remembered form.

11. The method according to claim 7 including a step of communicating the identification to the vehicle associated with the selected offer and displaying at least one symbol to the user at the associated boarding location when the associated vehicle arrives at the associated boarding location.

* * * * *